US007690651B2

(12) United States Patent
Kubochi

(10) Patent No.: US 7,690,651 B2
(45) Date of Patent: Apr. 6, 2010

(54) IMAGE FORMING APPARATUS AND REMAINING SHEET DETECTION METHOD THEREOF

(75) Inventor: Yutaka Kubochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 556 days.

(21) Appl. No.: 11/669,715

(22) Filed: Jan. 31, 2007

(65) Prior Publication Data

US 2007/0182091 A1 Aug. 9, 2007

(30) Foreign Application Priority Data

Feb. 3, 2006 (JP) ..... 2006-027713

(51) Int. Cl.
*B65H 7/02* (2006.01)

(52) U.S. Cl. ..... 271/265.01; 271/258.01

(58) Field of Classification Search ..... 271/3.17, 271/258.01, 259, 265.01
See application file for complete search history.

(56) References Cited

U.S. PATENT DOCUMENTS

| | | | | |
|---|---|---|---|---|
| 4,025,187 | A * | 5/1977 | Taylor et al. | 399/394 |
| 4,135,804 | A * | 1/1979 | Schoppe et al. | 399/396 |
| 4,936,567 | A * | 6/1990 | Fukui | 271/246 |
| 4,941,021 | A * | 7/1990 | Uchida et al. | 399/322 |
| 5,081,490 | A * | 1/1992 | Wakao | 399/17 |
| 5,738,349 | A * | 4/1998 | Shirasaki | 271/242 |
| 5,775,690 | A * | 7/1998 | Quesnel et al. | 271/242 |
| 6,361,036 | B1 * | 3/2002 | Nakazawa | 270/58.07 |
| 6,538,718 | B2 * | 3/2003 | Ando et al. | 355/50 |
| 6,674,979 | B2 * | 1/2004 | Nagano | 399/68 |
| 6,892,038 | B2 * | 5/2005 | Fukutani | 399/68 |
| 7,398,027 | B2 * | 7/2008 | Koshida et al. | 399/68 |
| 7,409,172 | B2 * | 8/2008 | Koshida | 399/68 |
| 7,426,353 | B1 * | 9/2008 | Sakakibara | 399/68 |
| 2002/0131068 | A1 * | 9/2002 | Ishii et al. | 358/1.14 |
| 2006/0251439 | A1 * | 11/2006 | Sugiyama | 399/68 |
| 2009/0129797 | A1 * | 5/2009 | Suzuki et al. | 399/44 |

FOREIGN PATENT DOCUMENTS

| | | | |
|---|---|---|---|
| JP | 55028015 | A * | 2/1980 |
| JP | 10-340012 | A | 12/1998 |
| JP | 2000-352850 | A | 12/2000 |
| JP | 2000335027 | A * | 12/2000 |
| JP | 2001097602 | A * | 4/2001 |
| JP | 2006309188 | A * | 11/2006 |
| JP | 2008158076 | A * | 7/2008 |

* cited by examiner

*Primary Examiner*—Patrick H Mackey
*Assistant Examiner*—Howard Sanders
(74) *Attorney, Agent, or Firm*—Canon U.S.A., Inc., IP Division

(57) ABSTRACT

An image forming apparatus is provided that detects a sheet remaining between a transfer unit and fixing unit using a loop sensor. The loop sensor is configured to detect a loop of a sheet conveyed between the transfer unit and the fixing unit. The image forming apparatus includes a control unit to control, in accordance with an output from the loop sensor, a sheet conveyance speed of the fixing unit so as to form the loop of the sheet conveyed by the transfer unit and the fixing unit. If the loop sensor detects a presence of the sheet while driving of the transfer unit and the fixing unit for conveying the sheet has stopped, the control unit determines that a remaining sheet is present, and outputs a warning signal.

13 Claims, 9 Drawing Sheets

IMAGE FORMING APPARATUS AND REMAINING SHEET DETECTION METHOD THEREOF

BACKGROUND OF THE INVENTION

1. Field of the Invention

The present invention relates to an image forming apparatus which forms and develops an electrostatic latent image on an image carrier, and transfers and fixes the developed image on a sheet material to form an image, and a remaining sheet detection method for the apparatus.

2. Description of the Related Art

A conventional image forming apparatus such as a laser printer or copying machine attaches a paper cassette which stores a plurality of stacked sheets, and picks up the sheets in the paper cassette one by one and conveys the picked-up sheet into the apparatus body when printing an image. In such an apparatus, the conveyed sheet is sandwiched between a registration roller pair located on the upstream side of a transfer unit, and fed to the transfer unit by rotation of the registration roller pair. A top sensor which detects the leading edge of the sheet is arranged on the downstream side of the registration roller pair. When the top sensor detects the arrival of the sheet, the conveyance of the sheet is synchronized with an image forming operation on a photosensitive drum.

A loop sensor is arranged between the transfer unit and a fixing unit (see Japanese Patent Laid-Open No. 2000-352850). This loop sensor detects the slack (also referred to herein as a loop) of a sheet between the transfer unit and fixing unit while the leading edge of the sheet on which an image has been transferred is fed to a nip portion between a fixing roller pair but the trailing edge of the sheet has not passed through a nip portion in the transfer unit (between the transfer rollers). The rotating members (rollers) of the transfer unit and fixing unit are driven by separate motors. The rotational speed of the motor which drives the roller of the fixing unit changes in accordance with a signal detected by the loop sensor. That is, the loop sensor is turned on when the loop amount of the sheet between the transfer unit and fixing unit reaches a predetermined amount and the sheet pushes down the loop sensor. In this case, the image forming apparatus controls to decrease the loop amount by increasing the rotational speed of the roller of a fixing unit. On the other hand, the loop sensor is turned off when the loop amount decreases. In this case, the image forming apparatus controls to increase the loop amount by decreasing the rotational speed of the roller of the fixing unit. The rotational speed of the motor which drives the fixing unit changes in accordance with ON/OFF of the signal detected by the loop sensor, thereby changing the conveyance speed of the sheet conveyed by the fixing unit. Therefore, the image forming apparatus controls to keep the loop amount of the sheet almost constant between the transfer unit and fixing unit.

A delivery sensor is arranged on the downstream side of the fixing unit. The above-described top sensor and the delivery sensor function as sensors which detect the presence/absence of a sheet, and are used to detect a remaining sheet in a conveyance path in case of a jam or the like.

However, the conventional image forming apparatus with the above-described arrangement has the following problems. That is, the conventional loop sensor is a sensor dedicated to control the loop amount of a sheet when conveying the sheet. More specifically, the loop sensor is used only for control of the loop amount, and there is no means to detect the presence/absence of a sheet between the top sensor and delivery sensor when the image forming apparatus stops. Hence, when a jam occurs by a sheet remaining between the transfer unit and fixing unit, the sheet may not be detected. When the sheet remaining between the transfer unit and fixing unit is not detected, the image forming apparatus may perform a forward rotation operation to initialize the apparatus body without consideration of the jam. In such a case, the recovery process from the jam may be difficult to perform because, e.g., the remaining sheet winds around the roller of the fixing unit.

Adding another sensor for detecting a jam requires various modifications and changes such as an increase in the number of units and a change in a print engine, resulting in an increase in the cost of the product.

SUMMARY OF THE INVENTION

Embodiments of the present invention are directed to an image forming apparatus capable of reliably detecting a sheet remaining between a transfer unit and fixing unit at low cost, and a remaining sheet detection method for the apparatus.

According to one aspect of the present invention, an embodiment is directed to an image forming apparatus comprising: an image carrier; a transfer unit configured to transfer, to a sheet, an image formed on the image carrier; a fixing unit configured to fix the image transferred on the sheet by the transfer unit; a loop sensor configured to detect a loop of the sheet conveyed by the transfer unit and the fixing unit; and a control unit configured to control, in accordance with an output from the loop sensor, a sheet conveyance speed in the fixing unit so as to form the loop of the sheet conveyed by the transfer unit and the fixing unit, wherein when the loop sensor detects the sheet while driving of the transfer unit and the fixing unit for conveying the sheet stops, the control unit determines that a remaining sheet is present, and outputs a warning signal.

According to one aspect of the present invention, an embodiment is directed to a method comprising: controlling a sheet conveyance speed using a fixing unit to form a loop of a sheet in accordance with an output from a loop sensor configured to detect the loop of the sheet, while conveying the sheet between a transfer unit configured to transfer an image to the sheet and the fixing unit configured to fix the image on the sheet; and determining whether a remaining sheet is present in the image forming apparatus in accordance with the output form the loop sensor while driving of the transfer unit and the fixing unit for sheet conveyance stops.

Further features of the present invention will become apparent from the following description of exemplary embodiments with reference to the attached drawings.

DESCRIPTION OF THE EMBODIMENTS

Embodiments of the present invention will be described in detail in accordance with the accompanying drawings. The present invention is not limited by the disclosure of the embodiments and all combinations of the features described in the embodiments are not always indispensable to solving means of the present invention.

Figure 1:
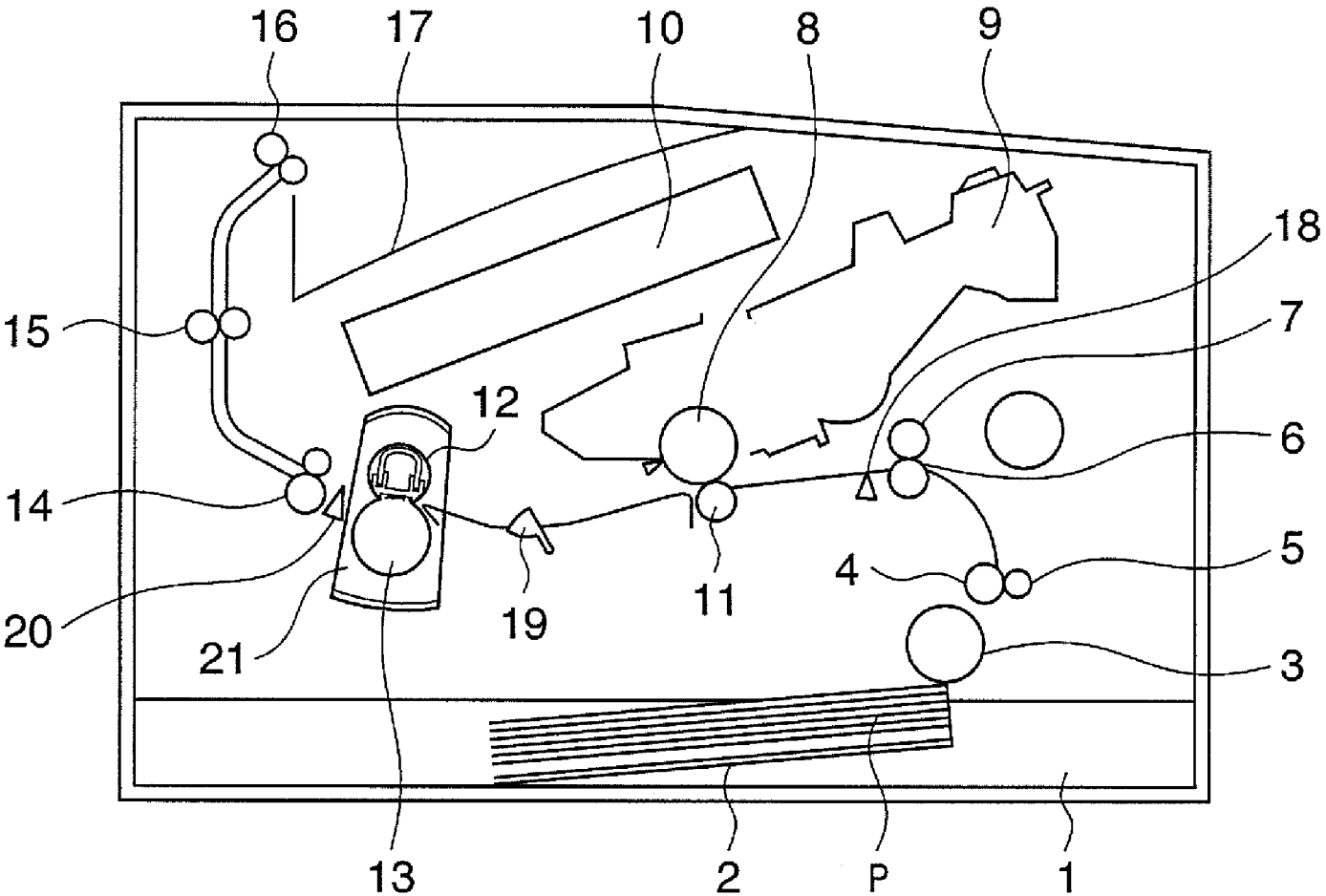
FIG. 1 is a view for explaining the schematic arrangement of a laser printer as an example of an image forming apparatus according to an embodiment.

FIG. 1 is a view for explaining the schematic arrangement of a laser printer as an example of an image forming apparatus according to one embodiment.

The illustrated laser printer includes a sheet feeder having a feed tray 1, sheet stacker 2, and feed roller 3. Sheets P stacked on the sheet stacker 2 in the feed tray 1 are picked up one by one from the uppermost sheet P by rotation of the feed roller 3. The picked-up sheet P is conveyed to a registration unit by a conveyance roller 4 and conveyance runner 5. The conveyance direction of the sheet P is adjusted in one direction by the registration portion including a registration roller 6 and registration runner 7, and the sheet P is fed to a transfer unit (image forming unit).

The image forming unit serves as a toner cartridge 9 by forming a photosensitive drum 8, a charger which charges the photosensitive drum 8, a developer which develops an electrostatic latent image on the photosensitive drum 8 by toner, and a cleaner which removes and stores toner remaining on the photosensitive drum 8 into a unit. A laser scanner unit 10 is formed by forming a polyhedral mirror, polyhedral mirror rotating motor, and laser unit into a unit.

A laser beam modulated in accordance with image information is applied from the laser scanner unit 10 to the photosensitive drum 8 by scanning. This forms an electrostatic latent image on the photosensitive drum 8 in accordance with the image information. This electrostatic latent image is developed by toner serving as a developing agent using the developer, and the developed toner image is transferred, by a transfer roller 11, onto the sheet P conveyed from the photosensitive drum 8. The sheet P on which the toner image has been transferred is conveyed to a fixing unit 21 including a heating unit 12 and pressurizing roller 13, thereby heating and fixing the transferred toner image. The sheet P is then delivered to a delivery tray 17 by a delivery unit including an FU delivery roller 14, intermediate delivery roller 15, and FD delivery roller 16.

Reference numeral 18 denotes a top sensor which detects the arrival of the leading edge of the sheet P which has passed through the registration roller 6; 19, a loop sensor which detects the presence/absence of the sheet P between the fixing unit 21 and transfer roller 11, and the loop of the sheet; and 20, a delivery sensor which detects the sheet P on the delivery side of the fixing unit 21.

Figure 2:
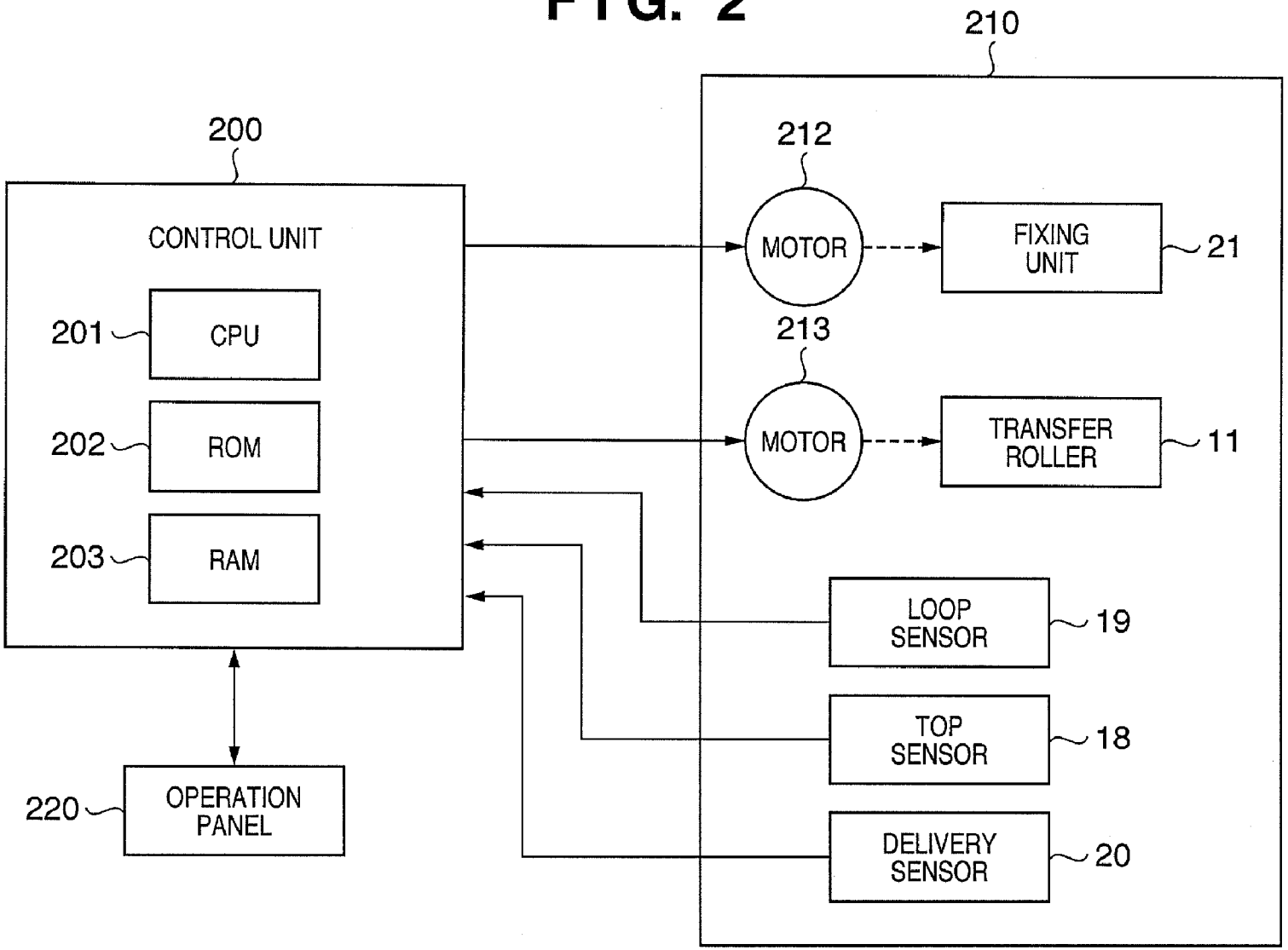
FIG. 2 is a block diagram for explaining the schematic arrangement of the laser printer according to the embodiment.

FIG. 2 is a block diagram for explaining the schematic arrangement of the laser printer according to this embodiment. The same reference numerals as in FIG. 1 denote the same parts in FIG. 2, and repetitive description will be omitted.

A control unit 200 controls the operation of the laser printer. A CPU 201 controls the operations of the overall printer in accordance with a control program stored in a ROM 202. The ROM 202 stores programs to be executed by the CPU 201, and various default values and data. A RAM 203 provides a work area for temporarily storing various data in a control process of the CPU 201, and also stores various flags and data to be referred to by a program (to be described later).

A printer engine 210 includes the image forming unit, toner cartridge 9, and feeding unit shown in FIG. 1, and implements a function of transferring an image corresponding to the input image information on the sheet P to form the image, under the control of the control unit 200. A motor 212 rotationally drives the roller of the fixing unit 21 in accordance with an instruction from the control unit 200. A motor 213 rotationally drives the transfer roller 11 of the image forming unit in accordance with an instruction from the control unit 200. In addition to these units, the printer engine 210 includes the photosensitive drum 8, the feed roller 3, the rotational driving mechanism which rotationally drives, e.g., the roller of the delivery unit shown in FIG. 1, the laser scanner unit 10, and the like. However, a description thereof will be omitted.

An operation panel 220 includes various buttons and operations switches to be operated by a user, and a display unit which displays a message to the user and an error such as a jam.

First Embodiment

Figure 3A:
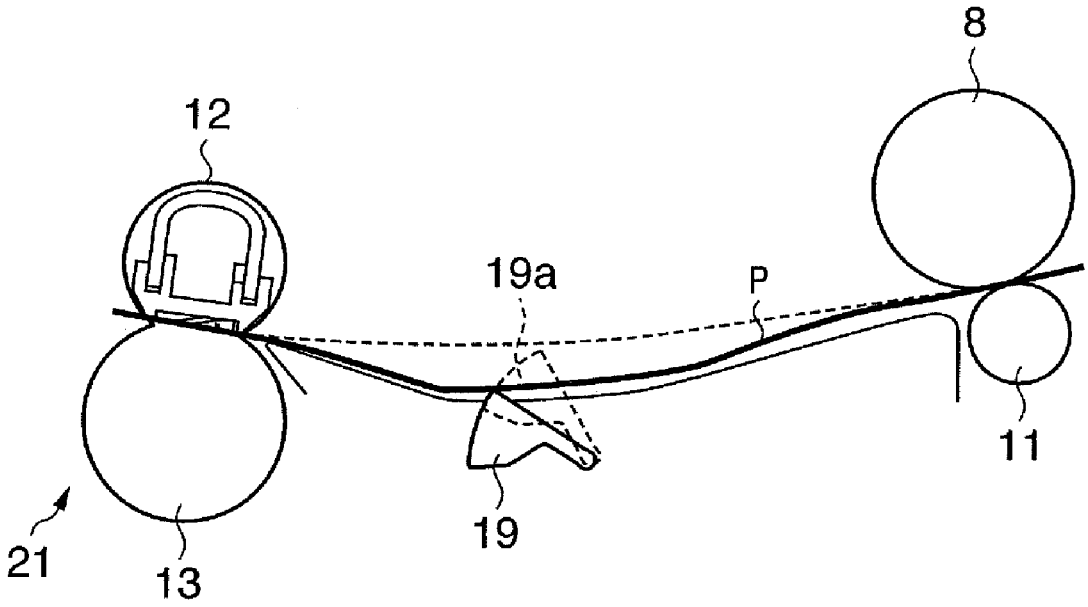
FIGS. 3A and 3B are views for explaining sheet conveyance between a transfer roller and fixing unit in the laser printer according to the first embodiment.
Figure 3B:
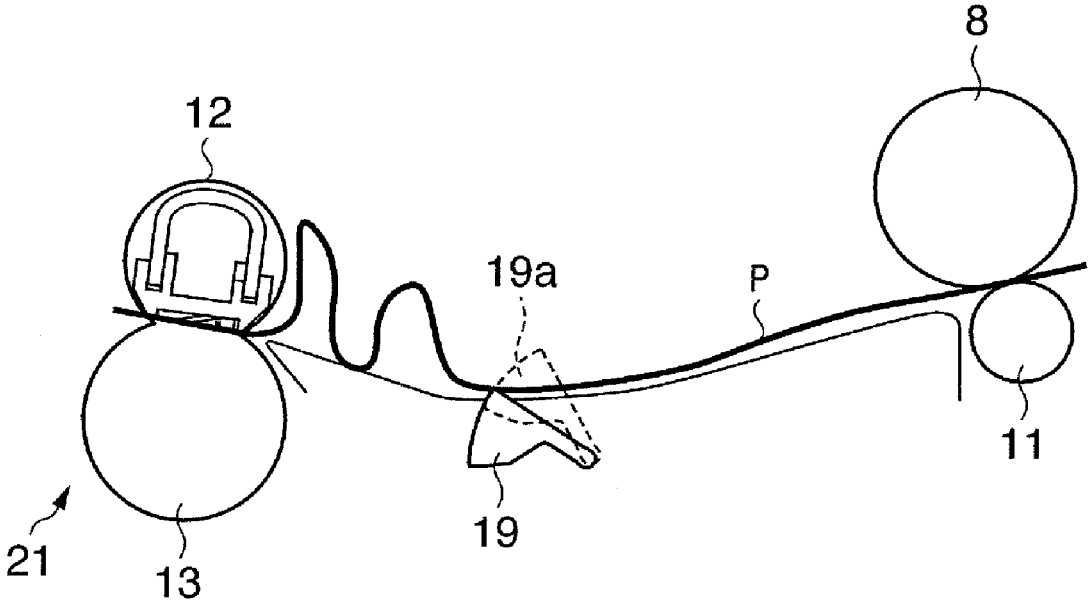

FIGS. 3A and 3B are views for explaining sheet conveyance between a transfer roller and fixing unit in a laser printer according to the first embodiment of the present invention.

In the first embodiment, a loop sensor 19 which is arranged between a transfer unit (transfer roller 11) and a fixing unit 21, and detects the loop amount (e.g., slack amount, bending amount) of a sheet P serves as a sheet presence/absence sensor.

Referring to FIG. 3A, the loop sensor 19 detects a sheet and turns on the sensor output when the loop (e.g., slack, bending) of the sheet P is formed. The loop sensor 19 does not detect a sheet and turns off the sensor output when the sheet P moves to a position indicated by the dotted line in FIG. 3A (The loop of the sheet P is not formed). Referring to FIG. 3B, the depression force of the sheet P does not act on the loop sensor 19 even when sheet conveyance fails so the sheet P waves and causes a jam. In such state, the loop sensor 19 is located on the upper side (OFF state) as indicated by a dotted line 19*a*. In this case, the sensor output is also turned off.

When the sheet P is present and the loop is formed in FIG. 3A, the loop sensor 19 is pushed down by the sheet P and moved to the lower side as indicated by the solid line. In this case, the output from the loop sensor 19 becomes ON.

As described above, the loop sensor 19 functions as a sensor which detects the loop amount of the sheet P when the sheet P is conveyed, and functions as a sheet presence/absence sensor (a sensor for detecting a jam) when the sheet P is not conveyed. That is, if the output from the loop sensor 19 is ON when the sheet P is not conveyed, the CPU determines that the sheet P remains in the loop sensor 19, and notifies a user of the occurrence of a jam by displaying it on an operation panel 220.

Figure 9:
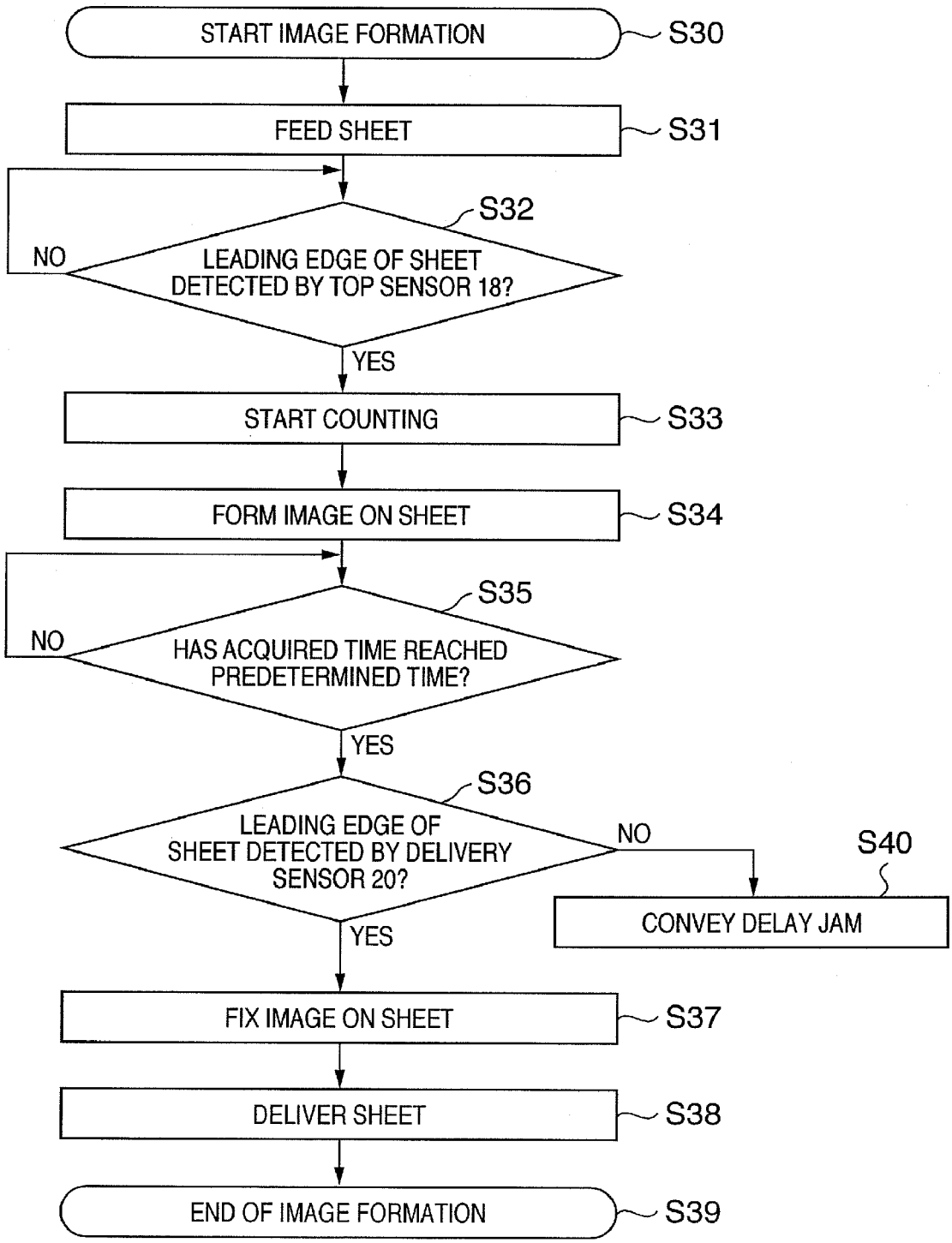
FIG. 9 is a flowchart for explaining a sheet conveyance delay jam according to the embodiment.

FIG. 9 is a flowchart for explaining control to detect a conveyance delay jam when the conveyance of the sheet P delays as shown in FIG. 3B. Upon starting an image forming operation (step S30), the sheet P is fed and conveyed (step S31).

The CPU determines whether a top sensor 18 detects the leading edge of the sheet P (step S32). If the result is YES in step S32, a control unit 200 starts counting (step S33) to form an image on the sheet P (step S34). If the result is NO in step S32, the image forming apparatus stands by until the top sensor 18 detects the leading edge of the sheet P.

Upon starting the counting operation, the CPU determines whether the acquired time has reached a predetermined time (step S35). If the result is YES in step S35, the CPU determines whether a delivery sensor 20 has detected the leading edge of the sheet P (step S36).

If the result is YES in step S36, the image on the sheet P is fixed (step S37), the sheet P is delivered to a tray 17 (step S38), and the image formation process ends (step S39).

If the result is NO in step S36, the sheet P may have jammed in the state shown in FIG. 3B. Hence, the CPU determines that a conveyance delay jam has occurred, and the operation of the apparatus stops (step S40).

The above-described predetermined time is a time determined based on the conveyance distance between the sheet feed position and the delivery sensor 20, and the sheet conveyance speed.

Figure 4:
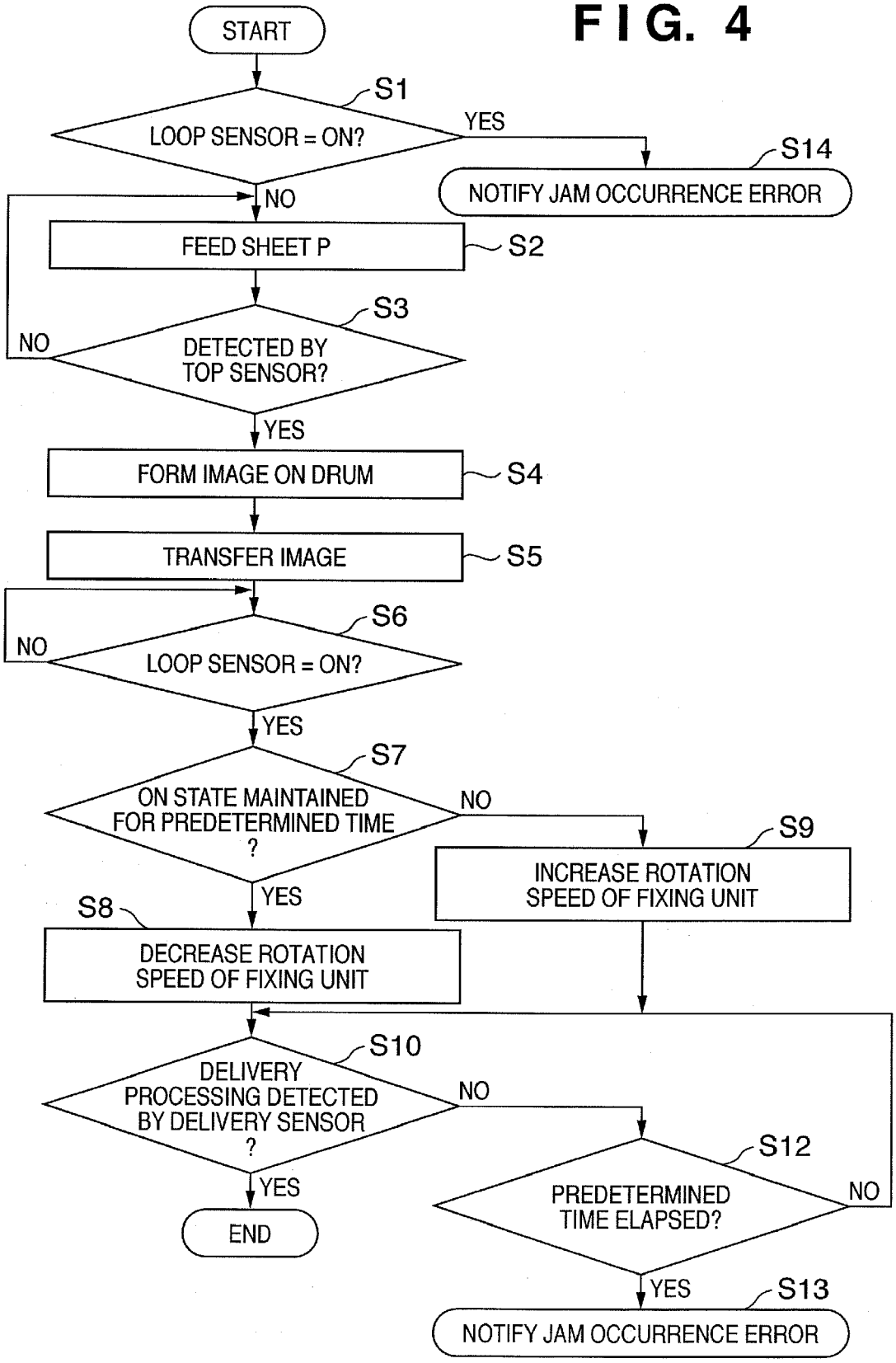
FIG. 4 is a flowchart for explaining a jam detecting process in the laser printer according to the embodiment.

FIG. 4 is a flowchart for explaining a jam detection process in the laser printer according to this embodiment. In an embodiment, a program for executing this process is stored in a ROM 202 and executed under the control of a CPU 201.

The process shown in the flowchart of FIG. 4 starts when a host computer serving as an external apparatus or the like issues a print job start instruction. In step S1, before the sheet P is fed, the CPU checks whether the loop sensor 19 is ON, i.e., whether the loop sensor 19 detects the sheet P. If the result is YES in step S1, the process advances to step S14. In this case, the sheet P remains between the transfer roller 11 and fixing unit 21. Hence, the CPU determines that a jam (paper jam) has occurred, and displays, on the operation panel 220, information indicating that a jam error has occurred. The CPU also notifies the external apparatus of the jam error.

If the result is NO in step S1, the process advances to step S2. The CPU rotates a feed roller 3 to pick up the sheets P in a feed tray 1 one by one, and conveys it using a conveyance roller 4 and registration roller 6. When the top sensor 18 detects the leading edge of the sheet P, the CPU controls to form an image on a photosensitive drum 8 in synchronism with the detection of the sheet P. In step S5, the CPU transfers the toner image formed on the photosensitive drum 8 to the conveyed sheet P. The sheet P on which the toner image has been transferred is fed by rotation of the photosensitive drum 8 and transfer roller 11, and reaches the loop sensor 19, thereby turning on the output from the loop sensor 19 (in the state in which the loop sensor 19 detected the sheet). When this output is detected in step S6 (YES in step S6), the process advances to step S7. In step S7, the CPU determines whether the loop sensor 19 is to be maintained in the ON state for a predetermined time, i.e., whether the sheet P passes through the fixing unit 21 without forming a loop or whether the sheet P passes through the fixing unit 21 with forming a loop (the output from the sensor is OFF). If the result is YES in step S7, the process advances to step S8 to control rotation of a motor 212 in order to decrease the rotation speed of the roller of the fixing unit 21. If the result is NO in step S7, the process advances to step 9 to control rotation of the motor 212 in order to increase the rotation speed of the roller of the fixing unit 21. With these processes, the speed of sheet P is kept almost constant between the transfer roller 11 and fixing unit 21.

After step S8 or S9, the process advances to step S10 to check whether the delivery sensor 20 detects that the sheet P passed through the fixing unit 21 has been normally delivered. If the result is YES in step S10, the process ends. If the result is NO in step S10, and the delivery sensor 20 does not detect that the sheet P has been delivered within a predetermined time in step S12, the CPU determines that a jam of the sheet P has occurred, and notifies the user of the jam error as in step S14.

Figure 5:
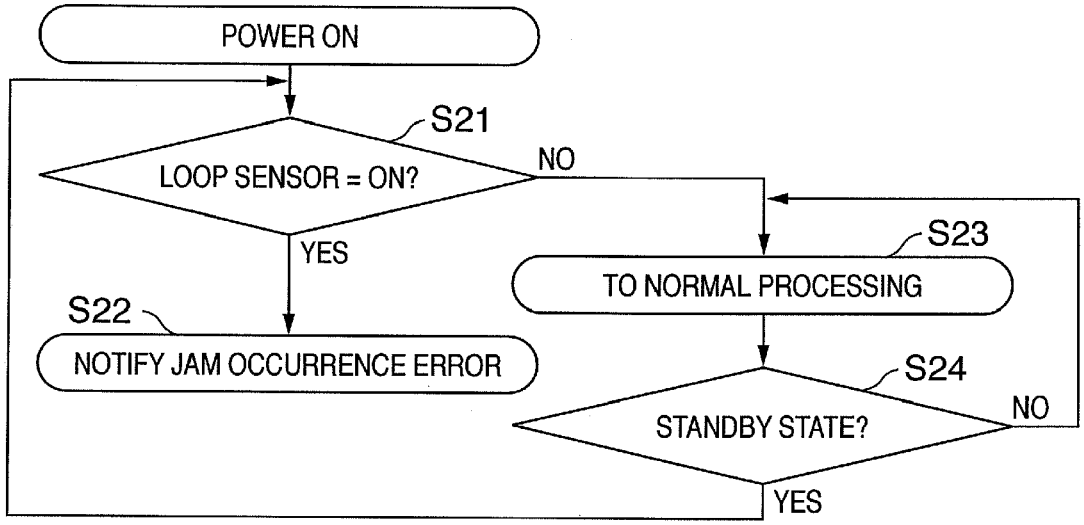
FIG. 5 is a flowchart for explaining a sheet jam detection process when the power supply of the printer is ON in an idle state without executing a print job.

FIG. 5 is a flowchart for explaining a sheet jam detection process in a print job standby state (print start standby state) when the printer is powered on. In an embodiment, the program for executing this process is stored in the ROM 202, and executed under the control of the CPU 201.

Referring to FIG. 5, the CPU checks in step S21 whether the loop sensor 19 is ON, i.e., whether the loop sensor 19 detects the sheet P, when the printer is powered on. If the result is YES in step S21, the process advances to step S22, and the CPU determines that a jam of a remaining sheet has occurred and notifies the user of the jam error as in step S13 shown in FIG. 4.

If the result is NO in step S21, the process advances to step S23 to execute a normal initialization process, print job reception process, and print job execution process. In step S24, the CPU determines whether the print job is not being executed, i.e., whether the laser printer is in the print job standby state. If the result is YES in step S24, the process returns to step S21 to check whether the loop sensor 19 detects the sheet P. If the loop sensor 19 detects the sheet P in such standby state (without executing the print job), the process advances to step S22 to notify the user of the jam.

As described above, when the loop sensor 19 detects a remaining sheet when the sheet P is not conveyed, it is determined that a jam of the sheet P has occurred.

According to the first embodiment, the loop sensor 19 which detects the loop of the sheet P between the transfer unit and fixing unit 21 serves as a remaining sheet detection sensor. Hence, the loop sensor 19 can detect the sheet P which remains in the printer but is not detected by the top sensor 18 and delivery sensor 20. As a consequence, a sheet remaining in the printer can be correctly detected.

According to an embodiment, a sensor for detecting such a state is not required, thereby suppressing an increase in cost of the apparatus.

Second Embodiment

The second embodiment of the present invention will be described next. The arrangement of a laser printer according to the second embodiment is the same as that in the first embodiment, and a detailed description thereof will be omitted.

Figure 6:
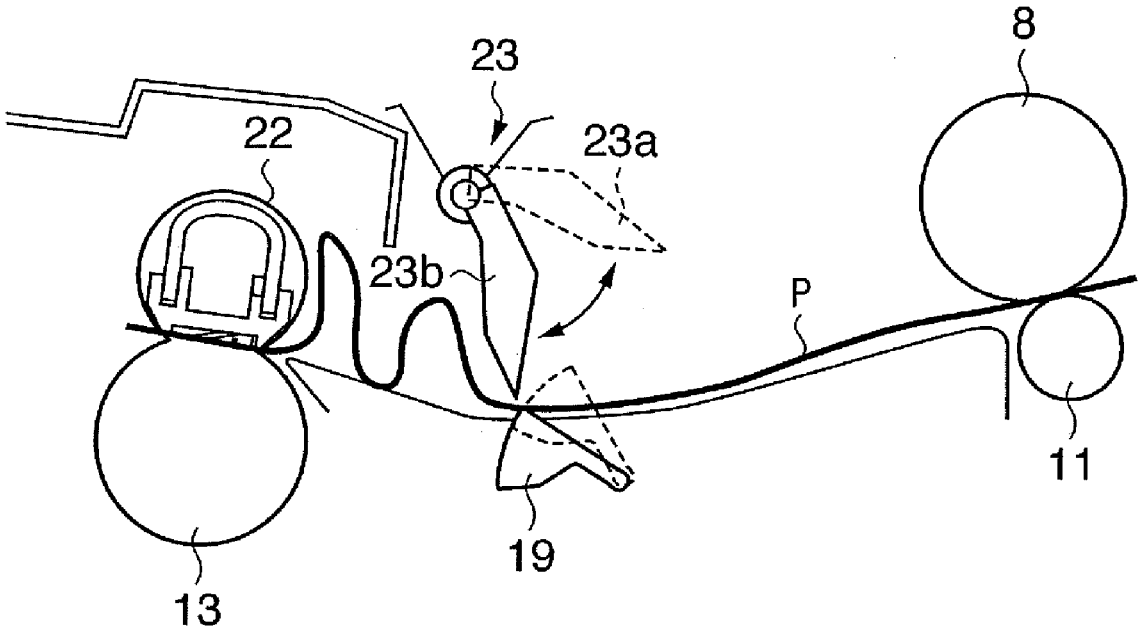
FIG. 6 is a view for explaining sheet conveyance between a transfer roller and fixing unit in a laser printer according to the second embodiment.
Figure 7:
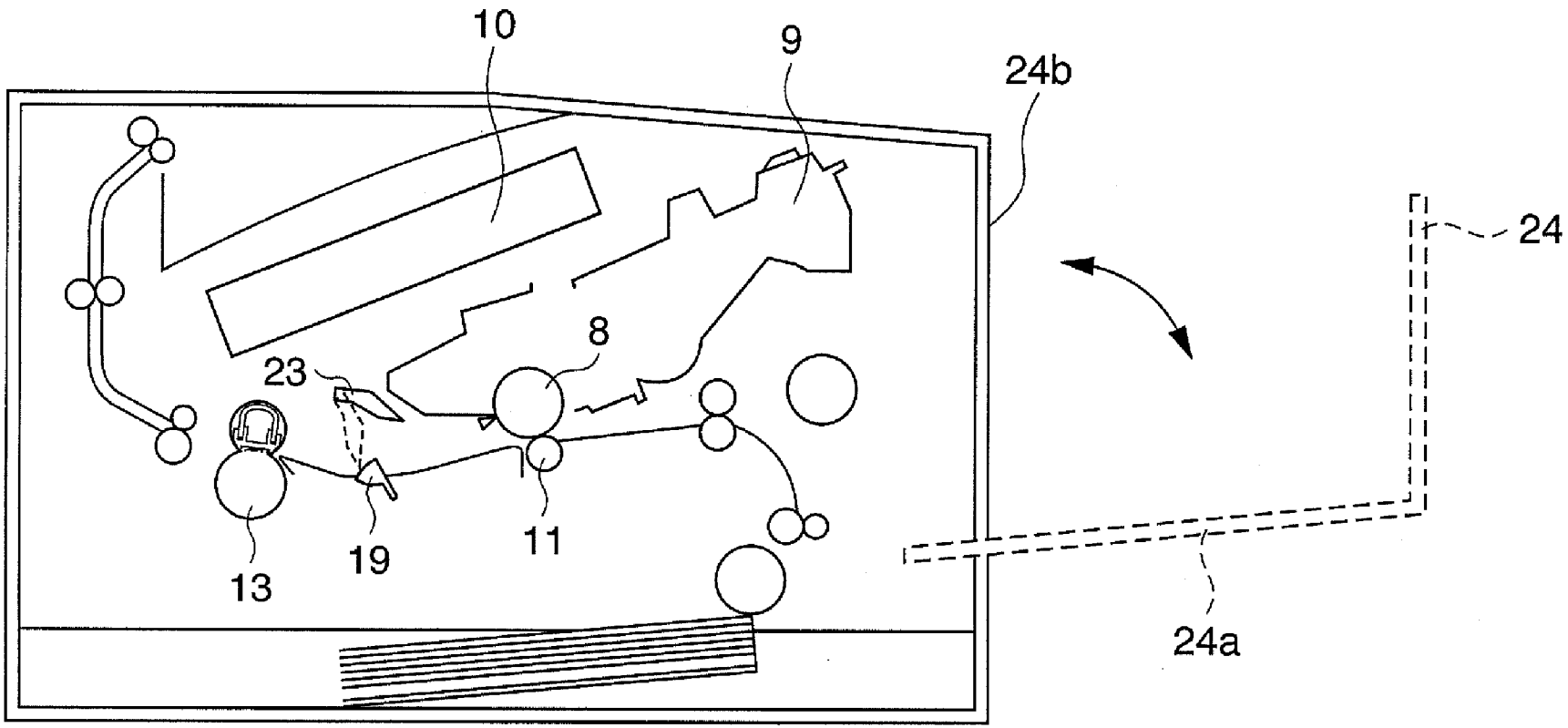
FIG. 7 is a view for explaining the schematic arrangement of the laser printer as an example of an image forming apparatus according to the second embodiment.

FIGS. 6 and 7 are views for explaining the main part of the printer according to the second embodiment. The same reference numerals as in the first embodiment denote the same parts in this embodiment.

FIG. 6 is a view for explaining sheet conveyance between a transfer roller and fixing unit in the laser printer according to the second embodiment of the present invention. FIG. 7 is a view for explaining the schematic arrangement of the laser printer as an example of an image forming apparatus according to the second embodiment.

In the second embodiment, a fixing shutter 23 is attached to a fixing unit 21 to prevent a user from touching a fixed film 22 and pressurizing roller 13 when removing a jammed sheet. The fixing shutter 23 is provided as a protection member for protecting the fixing unit 21. The fixing shutter 23 pivots in synchronism with the open/close operation of a cartridge door 24. That is, when the sheet is normally conveyed, the cartridge door 24 is closed (24*b*), and the fixing shutter 23 is located at an open position 23*a* to open a sheet conveyance path. When the user opens the cartridge door 24 (24*a*) in order to remove a jammed sheet or replace a toner cartridge 9, the fixing shutter 23 pivots to a close position 23*b* to cover the fixed film 22 and pressurizing roller 13.

As shown in FIG. 6, the fixing shutter 23 and a loop sensor 19 are located on opposite sides of the sheet conveyance path. When the user opens the cartridge door 24, the fixing shutter 23 pivots to a position immediately above the loop sensor 19. With this operation, when a sheet P remains between a transfer unit and the fixing unit 21, the fixing shutter 23*b* pivots and pushes down the remaining sheet P. The remaining sheet P pushed down by the fixing shutter 23 turns on the loop sensor 19.

According to the second embodiment, the fixing shutter 23 which is opened/closed in synchronism with the open/close operation of the cartridge door 24 is located at a position opposing the loop sensor 19. When the user opens the cartridge door 24, the fixing shutter 23 pivots to the close position, and pushes down the sheet P remaining between the transfer unit and fixing unit, thereby turning on the loop sensor 19. With this mechanism, the CPU can reliably detect the sheet remaining between the transfer unit and fixing unit.

Note that the jam detecting process in the second embodiment can also be implemented as in the first embodiment. Assume that in the standby state in step S24 shown in FIG. 5, the loop sensor 19 cannot detect the sheet P by forming a loop although the sheet P remains between the transfer unit and fixing unit 21. In this case, when the user opens the cartridge door 24 in order to replace a cartridge, the fixing shutter 23 pivots to the close position, and pushes down the remaining sheet P, thereby turning on the loop sensor 19. Hence, the CPU detects the ON state of the loop sensor 19, and recognizes the occurrence of a jam in step S21.

Third Embodiment

Figure 8:
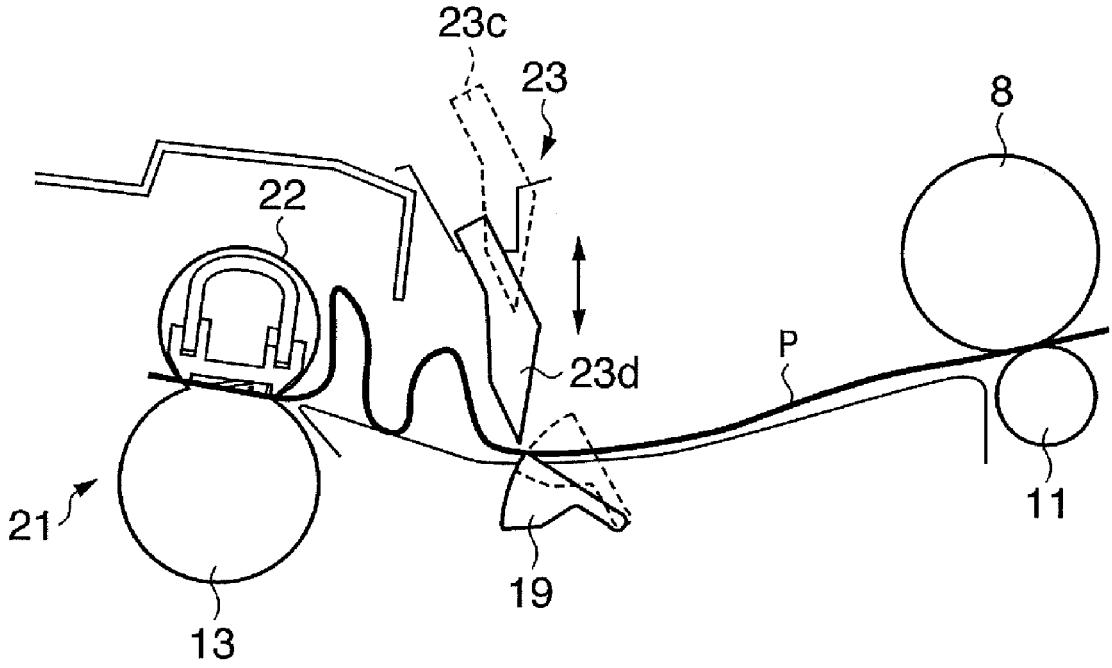
FIG. 8 is a view for explaining sheet conveyance between a transfer roller and fixing unit in a laser printer according to the third embodiment.

FIG. 8 is a view for explaining sheet conveyance between a transfer roller and fixing unit in a laser printer according to the third embodiment of the present invention. FIG. 8 shows only the characteristic features of the laser printer. Except for that, the arrangement and function of this embodiment are the same as those of the second embodiment, and a description thereof will be omitted.

In the third embodiment, the fixing shutter 23 vertically slides in synchronism with the open/close operation of a cartridge door 24. That is, when the sheet is normally conveyed, the cartridge door 24 is closed, and the fixing shutter 23 is located at an upper position (23*c*) to open the upstream side of a fixing unit 21.

When the user opens the cartridge door 24, the fixing shutter 23 moves to a lower position (23*d*) to close the upstream side of the fixing unit 21. As shown in FIG. 8, the fixing shutter 23 and a loop sensor 19 are located on opposite sides of the sheet conveyance path. When the user opens the cartridge door 24, the fixing shutter 23 moves to a position immediately above the loop sensor 19. With this operation, when a sheet P remains between a transfer unit and the fixing unit 21, the moved fixing shutter 23*d* pushes down the remaining sheet P. The remaining sheet P pushed down by the fixing shutter 23 then turns on the loop sensor 19.

As described above, the fixing shutter 23 which vertically slides in synchronism with the open/close operation of the cartridge door 24 is located at a position opposing the loop sensor 19. When the user opens the cartridge door 24, the fixing shutter 23 moves to the close position, and pushes down the sheet P remaining between the transfer unit and fixing unit 21, thereby turning on the loop sensor 19. With this mechanism, the CPU can reliably detect the sheet P remaining between the transfer unit and fixing unit 21.

As described above according to these embodiments, the loop sensor 19 which detects the loop amount of the sheet between the transfer unit and fixing unit can serve as the sheet presence/absence sensor. The loop sensor 19 can detect the remaining sheet P even when the sheet P remaining in the apparatus can be detected neither by the top sensor nor the delivery sensor. Therefore, the sheet remaining in the apparatus can be correctly detected.

In this arrangement, the fixing shutter 23 which is opened/closed in synchronism with the open/close operation of the cartridge door 24 is located at a position opposing the loop sensor 19. When the user opens the cartridge door 24 in order to replace a cartridge, the fixing shutter pushes down the remaining sheet. Therefore, when the sheet remains, the loop sensor 19 is reliably turned on, and can reliably detect the remaining sheet between the transfer unit and fixing unit.

Additionally, the fixing shutter 23 which vertically slides in synchronism with the open/close operation of the cartridge door 24 is located at a position opposing the loop sensor 19. When the user opens the cartridge door 24, the fixing shutter pushes down the remaining sheet to turn on the loop sensor 19. Therefore, the loop sensor 19 can reliably detect the remaining sheet between the transfer unit and fixing unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-027713, filed Feb. 3, 2006, which is hereby incorporated by reference herein in its entirety.

What is claimed is:

1. An image forming apparatus comprising:

an image carrier;

a transfer unit configured to transfer, to a sheet, an image formed on the image carrier;

a fixing unit configured to fix the image transferred on the sheet by the transfer unit;

a loop sensor configured to detect a loop of the sheet conveyed by the transfer unit and the fixing unit;

a control unit configured to control, in accordance with an output from the loop sensor, a sheet conveyance speed in the fixing unit so as to form the loop of the sheet conveyed by the transfer unit and the fixing unit; and a moving member configured to push the sheet remaining between the transfer unit and the fixing unit toward the loop sensor to assist the detection of the sheet using the loop sensor, wherein the moving member is configured to operate while the transfer unit and the fixing unit are stopped, and wherein when the loop sensor detects the sheet by operating the moving member, the control unit determines that a remaining sheet is present, and outputs a warning signal.

2. The apparatus according to claim 1, wherein the loop sensor includes a movable element that is pushed down by the sheet to be in a detecting state of the sheet when the loop of the sheet is formed or when a loop amount of the sheet is more than a predetermined amount, and the movable element of the loop sensor is not pushed down by the sheet to be in an undetecting state of the sheet when the sheet is absent or when the loop amount of the sheet is larger than or equal to the predetermined amount.

3. The apparatus according to claim 1, further comprising:

an opening/closing member movable between an opened position and a closed position, wherein the moving member is configured to move the sheet in a direction of the loop sensor in accordance with an opening operation of the opening/closing member.

4. The apparatus according to claim 3, wherein the moving member moves the sheet in the direction of the sensor upon rotating in accordance with the opening operation of the opening/closing member.

5. The apparatus according to claim 4, wherein the moving member comprises a protection member for protecting the fixing unit.

6. The apparatus according to claim 1, wherein the control unit determines that a remaining sheet is present, and outputs a warning signal when the loop sensor detects the sheet upon power-ON of the image forming apparatus.

7. The apparatus according to claim 1, further comprising a sheet detection sensor which detects a sheet on the downstream side in a sheet conveyance direction of the fixing unit, wherein the control unit determines that a remaining sheet is present and outputs a warning signal when determining that a sheet conveyance delay occurs based on an output from the sheet detection sensor, and detecting the sheet based on the output from the loop sensor.

8. A method for an image forming apparatus having a transfer unit which transfers an image to a sheet and a fixing unit which fix the image on the sheet, the method comprising:

controlling a sheet conveyance speed in the fixing unit so as to form a loop of the sheet in accordance with an output from a loop sensor which detects the loop of the sheet, while conveying the sheet between the transfer unit and the fixing unit;

operating a moving member configured to push the sheet remaining between the transfer unit and the fixing unit toward the loop sensor to assist the detection of the sheet using the poor sensor, while the transfer unit and the fixing unit are stopped; and determining whether a remaining sheet is present in the image forming apparatus in accordance with the detection of the sheet using the loop sensor.

9. The method according to claim 8, wherein the determination of a presence of a remaining sheet is executed upon power-on of the image forming apparatus.

10. The method according to claim 8, wherein the determination of a presence of a remaining sheet is executed when a sheet conveyance delay occurs when the image forming apparatus is in operation.

11. An image forming apparatus comprising:

an image carrier;

a transfer unit configured to transfer an image formed on the image carrier to a sheet;

a fixing unit configured to fix the image transferred on the sheet by the transfer unit;

a sensor capable of detecting a slack of the sheet between the transfer unit and the fixing unit;

a control unit configured to control, based on an output from the sensor, a sheet conveyance speed of the fixing unit so that the amount of the slack of the sheet forming between the transfer unit and the fixing unit may become a defined amount; and a moving member configured to push the sheet remaining between the transfer unit and the fixing unit toward the sensor to assist the detection of the sheet using the sensor, wherein the control unit is configured to determine if a presence of the sheet is detected by the sensor by operating the moving member after driving of the transfer unit and the fixing unit for conveying the sheet has stopped.

12. The apparatus according to claim 11, wherein the sensor is a loop sensor disposed between the transfer unit and the fixing unit.

13. The apparatus according to claim 11, wherein the moving member comprises a protection member for protecting the fixing unit.

* * * * *